US008443564B2

(12) United States Patent
Bankston, Jr.

(10) Patent No.: US 8,443,564 B2
(45) Date of Patent: May 21, 2013

(54) FIELD ADJUSTABLE GRID INTERSECTION CLIP

(75) Inventor: John D. Bankston, Jr., Amherst, OH (US)

(73) Assignee: USG Interiors, LLC, Chicago, IL (US)

( * ) Notice: Subject to any disclaimer, the term of this patent is extended or adjusted under 35 U.S.C. 154(b) by 0 days.

(21) Appl. No.: 13/163,775

(22) Filed: Jun. 20, 2011

(65) Prior Publication Data

US 2012/0017531 A1 Jan. 26, 2012

Related U.S. Application Data

(60) Provisional application No. 61/366,672, filed on Jul. 22, 2010.

(51) Int. Cl.
*E04B 9/12* (2006.01)

(52) U.S. Cl.
USPC ..... 52/506.07; 52/220.6; 52/665; 52/712

(58) Field of Classification Search
USPC ..... 52/220.6, 506.06, 506.07, 506.08, 52/665, 702, 712
See application file for complete search history.

(56) References Cited

U.S. PATENT DOCUMENTS

| | | | | | |
|---|---|---|---|---|---|
| 2,307,653 | A * | 1/1943 | Wright | 52/506.06 |
| 4,335,555 | A * | 6/1982 | Southerland et al. | 52/639 |
| 4,479,341 | A * | 10/1984 | Schuplin | 52/665 |
| 4,498,801 | A * | 2/1985 | Gilb | 403/232.1 |
| 4,527,375 | A * | 7/1985 | Braginetz | 52/712 |
| 4,713,923 | A * | 12/1987 | Sielaff et al. | 52/713 |
| 5,349,800 | A * | 9/1994 | Peng | 52/506.06 |
| 5,448,871 | A * | 9/1995 | Newman et al. | 52/712 |
| 5,640,822 | A * | 6/1997 | Haswell | 52/712 |
| 6,018,923 | A * | 2/2000 | Wendt | 52/712 |
| 6,209,268 | B1 * | 4/2001 | Schmidt | 52/92.1 |
| 6,837,019 | B2 * | 1/2005 | Collie | 52/712 |
| D611,332 | S * | 3/2010 | Tedesco et al. | D8/380 |
| 7,770,349 | B2 * | 8/2010 | Tedesco et al. | 52/506.08 |
| 7,788,875 | B2 | 9/2010 | Wendt | |
| 8,046,966 | B2 * | 11/2011 | Moore et al. | 52/506.06 |
| 8,250,827 | B2 * | 8/2012 | Lin et al. | 52/702 |
| 2008/0060306 | A1 * | 3/2008 | Platt et al. | 52/506.06 |
| 2011/0146194 | A1 * | 6/2011 | Tedesco et al. | 52/665 |

* cited by examiner

*Primary Examiner* — Brian Glessner
*Assistant Examiner* — Adriana Figueroa
(74) *Attorney, Agent, or Firm* — Prearne & Gordon LLP

(57) ABSTRACT

A clip for a suspended ceiling grid to join a pair of grid runners intersecting a third grid runner from opposite sides of the third grid runner, the clip being bendable sheet metal symmetrical about a vertical plane, having a saddle portion with a seat and generally planar flaps depending from opposite sides of the seat, including a pair of generally planar wings each cantilevered from a respective one of the flaps; the seat width corresponding to a hollow reinforcing bulb of a grid runner, the flaps extend over the sides of the reinforcing bulb and web of the third grid runner, a flap and wing joined at a vertical bend line, weaker than each adjacent area of the flap and wing whereby the wing can be manually bent to a desired angle relative to the flap.

7 Claims, 2 Drawing Sheets

FIELD ADJUSTABLE GRID INTERSECTION CLIP

This application claims the priority of U.S. Provisional Application No. 61/366,672, filed Jul. 22, 2010.

BACKGROUND OF THE INVENTION

The invention relates to suspended ceiling grid construction and, in particular, to an accessory for facilitating the construction of a custom grid.

PRIOR ART

Conventional suspended ceilings are initially constructed with grid runners, commonly in the shape of inverted tees. The grid runners or tees are arranged either at 90 degrees or parallel to one another in a rectangular array with the spacing between parallel elements being standardized. Main or through runners have regularly spaced openings or slots along their length that ordinarily determine the location of cross runners by accepting end connectors of these cross runners.

From time to time there can be a need, such as when a custom ceiling arrangement is specified by an architect, for intersecting grid runners to be oriented at other than 90 degrees. In such an arrangement, an in others, it may not be practical or possible to attach the intersecting or cross grid runners using their normal end connectors since the connectors are intended to make connections with the runners intersecting at 90 degrees and on module centers determined by connector slots formed in the manufacturing process of the main runners.

SUMMARY OF THE INVENTION

The invention is embodied in an adjustable clip capable of connecting intersecting grid cross runners or members analogous to cross runners, to a main or through runner, or a member analogous to a main runner, at angles other than 90 degrees and/or in positions other than on standard centers determined in the manufacturing process.

The clip, formed as a stamping of sheet metal, has a main body or saddle portion to be fixed on the through runner and divergent wings to be fixed to intersecting grid cross runners. The wings are integral with the saddle portion and are joined at hinge lines formed by weakened zones in the clip sheet metal where the wings merge with the saddle portion.

The saddle portion has a seat proportioned to stably rest on the reinforcing bulb of a through runner and flaps that extend downwardly over a web of the through runner. The wings are disposed to fit under the reinforcing bulb of the intersecting grid runners permitting the height of the intersecting grid runners to be vertically adjusted if necessary or desired.

The disclosed clip or bracket facilitates alignment of the opposing intersecting grid runners so as to avoid tedious, skillful and/or time consuming efforts in accomplishing this alignment task when a ceiling grid is being erected. The disclosed clip can also be used to locate opposing runners intersecting a through runner at 90 degrees where the intersection is off the standard module.

DESCRIPTION OF THE PREFERRED EMBODIMENT

Figure 1:
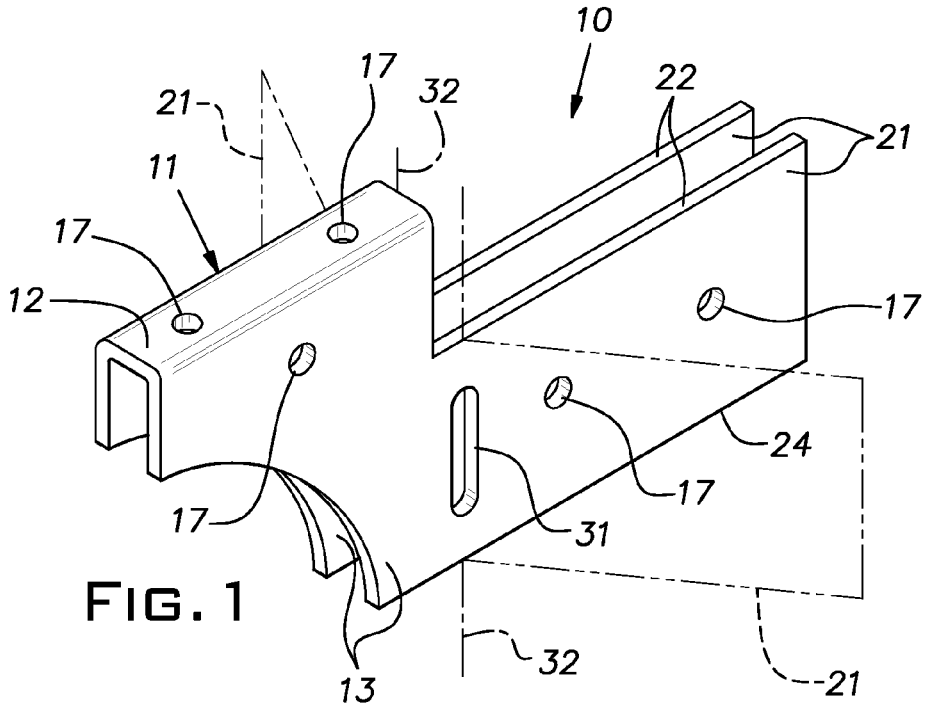
FIG. 1 is a perspective view of the clip of the invention.
Figure 2:
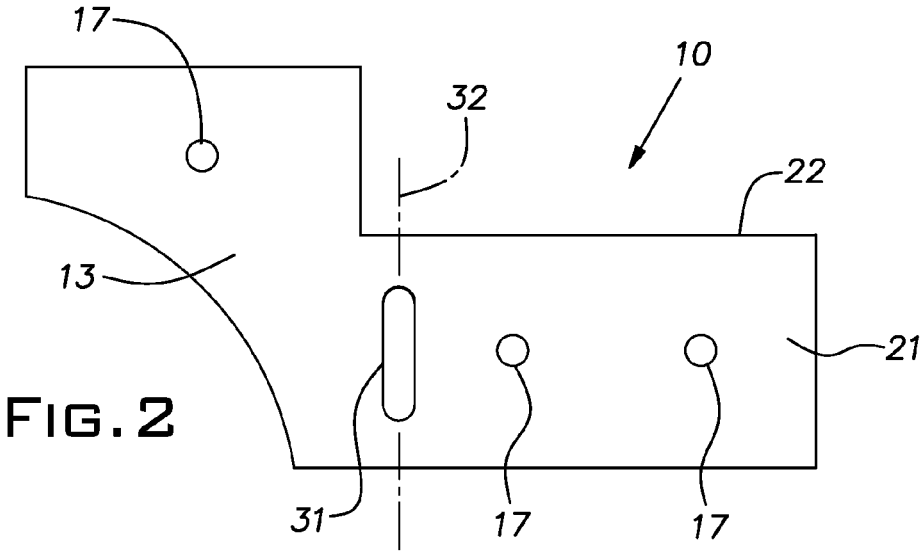
FIG. 2 is a side view of the clip of the invention.

A clip 10 embodying the invention is stamped from sheet metal, for example, from 0.040" gauge hot dipped galvanized steel. Preferably, the various elements of the clip are integral, being stamped from a single sheet. The clip 10 is manufactured and supplied to an installer in the solid line configuration shown in FIG. 1. The clip 10 has a saddle portion 11 including a horizontal seat 12 and depending vertical flaps 13 which together, when viewed from an end, have an inverted U-shaped configuration. The width of the seat 12 is arranged to space the flaps 13 so that they fit closely over a hollow reinforcing bulb 14, shown in FIG. 3, of a conventional grid through runner 16. Typically, this spacing is nominally a ¼" or metric equivalent. Grid runners illustrated in the various FIGS. have a traditional tee cross section and are commonly referred to as grid tees. It should be understood, however, that the clip 10 can be used with other grid runner profiles. The term through runner is intended to include conventional main runners or shorter runners intersected by other runners. Similarly, the term intersecting runner is intended to include the term cross runner which in ordinary construction denotes a grid runner that intersects at 90 degrees. The seat 12 and each flap 13 has at least one hole 17 for receiving a self-tapping screw or other fastener 18 for securing the clip 10 to a through runner hollow reinforcing bulb 14. The clip 10 is illustrated in an orientation in which it is normally used and it will be seen that the clip is symmetrical about a vertical plane that bisects the seat 12.

Extending horizontally from each flap 13 is a wing 21. In the illustrated embodiment, the wings 21 are rectangular in side profile. An upper edge 22 of a wing 21 is spaced vertically below the seat 12 of the saddle portion 11 a distance to fit below a reinforcing bulb 14 of an associated intersecting grid runner 23. Preferably, the location of this upper edge 22 and the location of a lower edge 24 relative to the seat 12 are determined so that a limited vertical adjustment of the intersecting runner 23 is possible without interference with the bulb 14 or with a lower flange 26 or like formation at the bottom of a web 27 of the intersecting runner 23. Each wing 21 is preferably provided with a plurality of holes 17 for receiving screws or other fasteners 18 that attach a wing to a web 27 of the associated intersecting grid runner. At a juncture between a wing 21 and a flap 13, an elongated vertical slot or perforation 31 is punched in the clip body to weaken it and form a vertical hinge or bend line 32.

Architectural designs which can be driven by a desire for an unusual ceiling appearance, by building floor plans or other considerations may require opposed grid runners 23 to intersect a through runner 16 at an angle other than 90 degrees and along lines that intersect at a common point at the through runner. Before or after the clip 10 is installed on a through runner 16, the wings 21 are positioned at desired angles relative to the saddle portion 11 corresponding to the angles of the intersecting runners. The wings 21 are manually bent or folded about the hinge lines 32 by exceeding the yield strength of the clip material at the bend line so that they remain at a desired angle.

The clip 10 is fixed to the bulb 14 of the through runner 16 at a location along the through runner at which the intersecting runners are to extend. One or more of the holes 17 in the saddle portion can be used to fix the clip 10 with a fastener to the through runner bulb 14. The disclosed clip facilitates the assembly of the opposing intersecting runners 23 to a through runner 16, in part, by establishing alignment points in the form of the hinge lines 32 that exist on both sides of the through runner and that are at the same location along the axis of the through runner.

With the clip 10 fastened to the through runner 16 and the wings bent at the hinge lines 32 to the desired angle, the intersecting grid runners 23 are secured to respective ones of the wings 21. The intersecting grid runners 23 are field cut to length with their flanges 26 either making a butt joint or a lap joint with through runner flanges 26. The vertical position of the top and bottom wing edges 22, 24, allows for limited adjustment of the intersecting grid runners 23.

Figure 3:
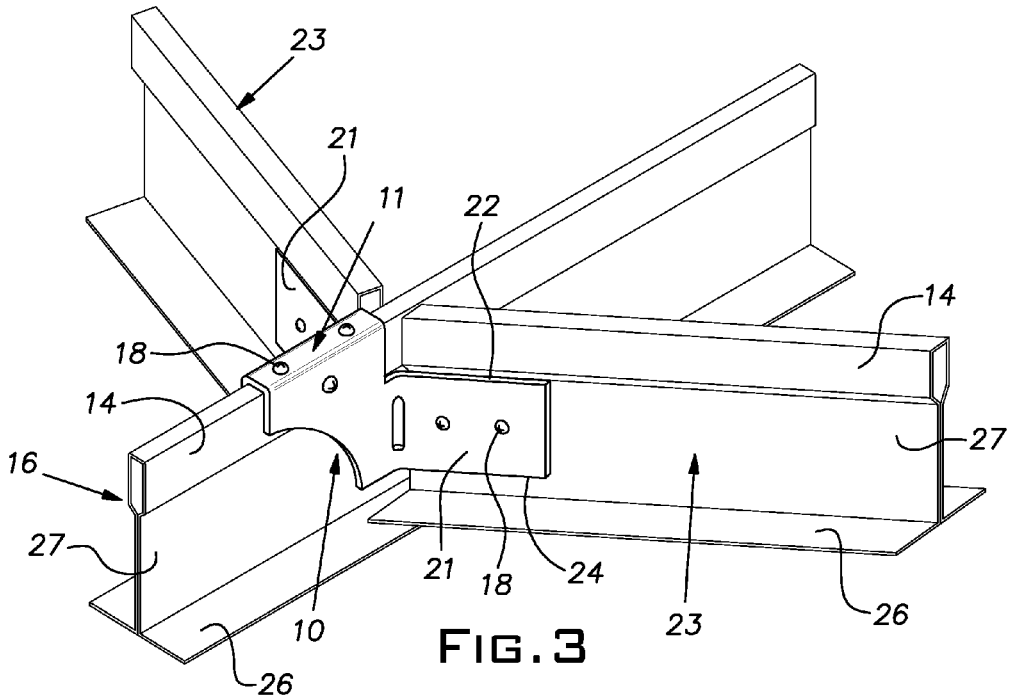
FIG. 3 is a perspective view of the clip of the invention assembled with a through runner and a pair of opposed intersecting runners.
Figure 4:
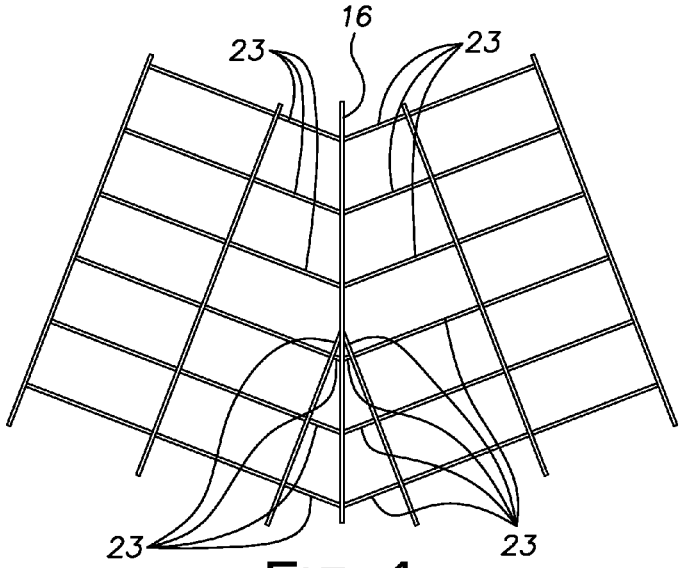
FIG. 4 is a schematic fragmentary plan view of an example of the use of the clip of the invention in angular grid areas.

FIG. 4 is a diagrammatic illustration of a suspended ceiling grid where pairs of opposed intersecting grid runners 23 are symmetrically joined to a through runner 16 with clips 10, the latter being shown in FIG. 3, but not FIG. 4, due to the seal of FIG. 4.

The clip 10 can be used in a variety of applications other than that described such as where the opposing intersecting grid runners are arranged along a common straight line at an angle other than 90 degrees or at 90 degrees to the through runner 16. The clip 10 can be located at essentially any point along the through runner 16 thus enabling intersecting runners 23, notably those at 90 degrees, to be located off the module centers determined by the connector slots in the through runner webs 27. Where desired or needed, the clip can be used to connect a single intersecting grid runner.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A clip for use in a suspended ceiling grid to join a pair of grid runners intersecting a third grid runner from opposite sides of the third grid runner, the clip being formed of bendable sheet metal and being symmetrical about a central vertical plane, the clip having a saddle portion with a seat and generally planar flaps depending from opposite sides of the seat, the clip including a pair of generally planar wings adjacent and extending past one end of the saddle with each cantilevered from a respective one of the flaps, an end of the saddle opposite said one end and being devoid of wings, the seat extending along a horizontal line, the seat having a width corresponding to the width of a hollow reinforcing bulb of a conventional grid runner having a height greater than the width, the saddle portion having a configuration such that the flaps are adapted to extend over the sides of the reinforcing bulb as well as a web below the reinforcing bulb of the third grid runner, the wings being integral with respective ones of the flaps, a flap and respective wing being joined at a vertical bend line located exclusively below the seat and spaced rearwardly of an end of the seat, the bend line being weaker than each adjacent area of the flap and wing whereby the wing can be manually bent to a desired angle relative to the flap, the wings having an upper edge spaced from the plane of the saddle seat a distance greater than the width of the seat such that the upper edge is adapted to fit below a reinforcing bulb of an intersecting grid runner when attached thereto.

2. A clip as set forth in claim 1, wherein said flaps have a hole to receive a screw for fastening the clip to a hollow reinforcing bulb of the grid runner.

3. A clip as set forth in claim 2, wherein each of the wings has at least one hole for receiving a screw to attach the wing to an associated intersecting grid runner.

4. A clip as set forth in claim 1, wherein said bend line is defined by at least one perforation.

5. A clip as set forth in claim 4, wherein said perforation is an elongated vertical slot.

6. A suspended ceiling grid comprising a plurality of grid runners intersecting a common through grid runner, the grid runners each having an upper hollow reinforcing bulb and a web below the bulb, the intersecting runners being arranged in pairs such that each one of a pair is on an opposite side of the through runner, a clip disposed on the through runner at the intersection of each pair of intersecting grid runners, the clip being formed of sheet metal and having a saddle shape portion positioned over and straddling the through runner, the clip being secured to the through runner hollow reinforcing bulb with a fastener, the clip on each side at one end of the saddle having an integral wing that extends past the saddle at a selected angle from a horizontal direction of the through runner, an end of the saddle opposite said one end being devoid of wings, an upper edge of each wing being disposed below the reinforcing bulb of the associated intersecting runner, a joint between a wing and the saddle shape portion, the joint being structured with a line of weakness to define a vertical hinge line between a wing and the saddle shape portion.

7. A suspended ceiling grid as set forth in claim 6, wherein the wings are disposed at equal angles relative to said central plane and each being fixed to a respective one of a pair of intersecting runners whereby the clip is adapted to maintain the respective intersecting runners so that they intersect the through runner at a common point.

* * * * *